US005826709A

United States Patent [19]

Jacob

[11] Patent Number: 5,826,709

[45] Date of Patent: Oct. 27, 1998

[54] SELF-ADJUSTING PLUNGER SWITCH

[75] Inventor: Hans-Ullrich Jacob, Stockach-Wahlwies, Germany

[73] Assignee: TRW Fahrzeugelektrik GmbH & Co. KG, Germany

[21] Appl. No.: 790,001

[22] Filed: Jan. 28, 1997

[30] Foreign Application Priority Data

Jan. 29, 1996 [DE] Germany ..... 196 03 135.4

[51] Int. Cl.[6] ..... H01H 13/70

[52] U.S. Cl. ..... 200/345; 200/342; 200/530; 200/284

[58] Field of Search ..... 200/61.89, 345, 200/342, 341, 520, 530, 531, 534, 536, 294, 295, 296, 537, 538, 539, 540, 541, 542, 284

[56] References Cited

U.S. PATENT DOCUMENTS

| | | | |
|---|---|---|---|
| 3,251,971 | 5/1966 | Fraser | 200/530 |
| 4,227,060 | 10/1980 | Ayres et al. | 200/296 |
| 4,239,947 | 12/1980 | Breitung et al. . | |
| 4,604,506 | 8/1986 | Gebhardt . | |
| 5,154,282 | 10/1992 | Pascal | 200/345 |
| 5,389,756 | 2/1995 | Micallef | 200/345 |
| 5,512,717 | 4/1996 | Magome et al. | 200/295 |

FOREIGN PATENT DOCUMENTS

| | | |
|---|---|---|
| 29 21 439 A1 | 12/1979 | Germany . |
| 35 27 874 A1 | 2/1987 | Germany . |

*Primary Examiner*—David J. Walczak

*Attorney, Agent, or Firm*—Fay, Sharpe, Beall, Fagan, Minnich & McKee

[57] ABSTRACT

A self-adjusting plunger switch having a housing (3) carrying contacts (7, 19) with an actuation element (5, 27) for actuation of the contacts (7, 19). A resilient element (11) biases the actuating element outwardly of the housing toward an inoperative position. The actuating element comprises a housing-guided slider (5) and a plunger (27) adjustably connected with the slider. The plunger (27) has a first stop arrest (45) which can be brought from an adjustment between the plunger (27) and the slider (5) through rotational movement around the longitudinal axis of the plunger to engage with a second stop arrest (29*a*) of the slider as a result of which an arrest of the position between the plunger (27) and slider (5) is attainable.

27 Claims, 3 Drawing Sheets

Fig. 2a
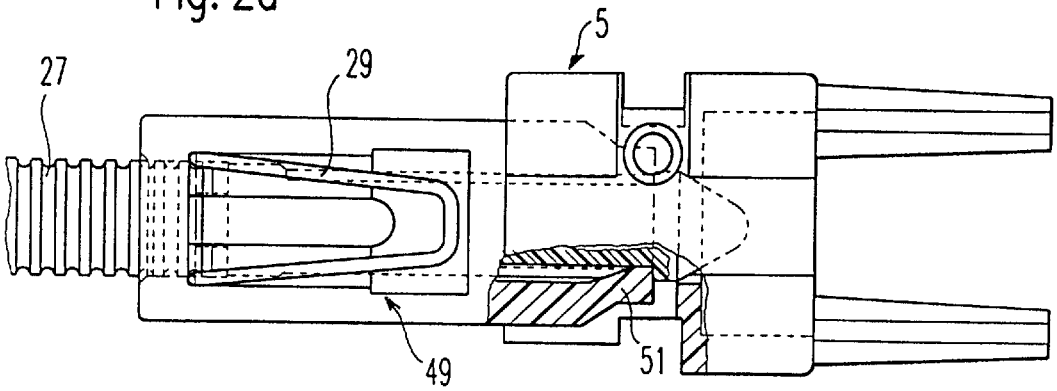
Fig. 2b
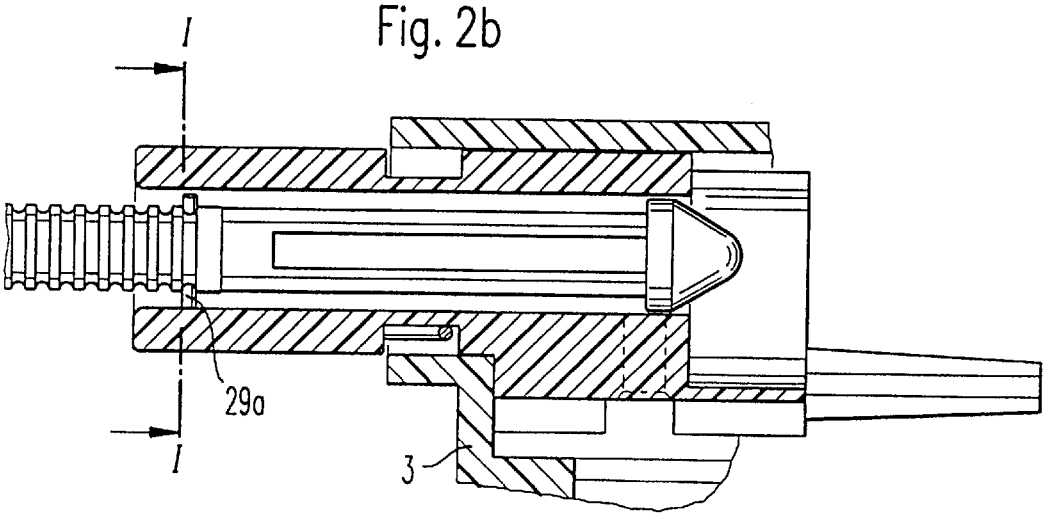
Fig. 2c
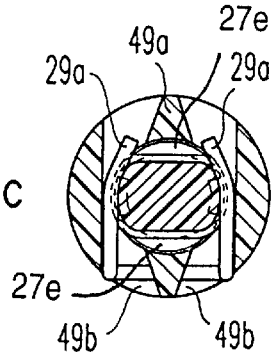
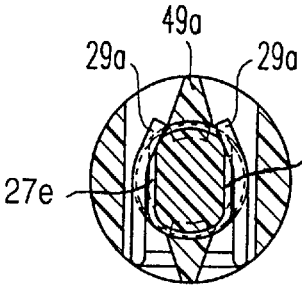
Fig. 2d

SELF-ADJUSTING PLUNGER SWITCH

BACKGROUND OF THE INVENTION

The invention relates to a self-adjusting plunger switch.

Pursuant to the state of the art, self-adjusting plunger switches are already known in many different design forms. They are used, for example, in motor vehicles as brake light switches. Switches designed in this fashion serve the purpose of compensating during installation of the switch for tolerances or changes in the operating path of the operating component, for example, the brake pedal. To that end, self-adjusting plunger switches have in the housing of the switch a displaceably guided activation element to activate at least one contact. The activation element comprises a controller slide unit mounted inside the housing and a plunger adjustably connected with the slider unit in the operating direction. Customarily, the plunger is lockably connected with the slider unit so that the desired switch point of the switch can be obtained by an adjustment of the plunger in the slider unit.

To begin with, the self-adjusting plunger is installed in the desired position in the vehicle and the plunger is locked with the slider unit in its outermost protruding position. After installation of the switch, the operating component, for example the brake pedal, is forcefully moved in the operating direction, whereby initially the slider unit is moved into its end position and subsequently the plunger is pushed with its stop zone a corresponding distance into the slider unit. As a result, tolerances are compensated during installation of the switch and/or the operating path of the brake pedal. Furthermore, this results in the advantage that with a sufficiently large stop zone between the plunger and slider unit, damage to the switch is safely avoided in case there is a change in the operating path, for instance the path of the pedal.

German Patent No. 3527874 A1 describes a self-adjusting plunger switch with a hollow cylindrical shaft element which is insertable into a bore of a plate. At one end, the shaft element has at its interior surface at least one stop nose protruding toward the interior which engages with a thread turn of the shaft. The shaft is a component of the switching device and has at one side a button and at the other side a switch housing in which are located the contact elements. In order to adjust the switching device, the button is stressed by an activation element, for instance a brake pedal, whereby the shaft is pushed back into the shaft element until the switch button is at the desired distance with respect to the activation element.

From German Patent No. 2921439 A1, a plunger switch is known which is specifically employable as bracket light switch. This plunger switch is pushed through a casing, serving for fastening the switch in a mounting aperture, until the plunger is in contact with the brake pedal and the end surface of the shaft abuts the pedal. The switch is then rotated relative to the casing by a narrow angle, whereby fins and grooves of the switch are made to engage with corresponding fins and grooves of the casing. In this manner, the switch is axially fixed relative to the casing.

The known self-adjusting plunger switches have, however, the drawback that under certain circumstances there may occur an unintended shifting in the desired locking position between the plunger and the slider unit. The heat expansion of switch components or the wear and tear of the locking zones may specifically contribute to this condition. Manipulation in the area of the switch can also lead to an unintended shifting of the desired locking position (after self-adjustment has taken place). This results in a shifting of the switch point, so that for example, the brake light is not switched on until a certain brake pedal position is reached which is beyond the point at which a significant brake effect has already been achieved. Prior to reaching said switch point, the vehicle following the braking vehicle has no indication at all of the already initiated braking process.

BRIEF DESCRIPTION OF THE INVENTION

The present invention is therefore based on the object of creating a self-adjusting plunger switch wherein after completed self-adjustment of the self-adjusting unit of the plunger, the relative position between plunger and slider unit is securely fixed.

The invention achieves this object with the characteristics of patent claim 1. In particular, by providing first arresting means at the plunger and having the first arresting means arranged at an angular adjustment position, an adjustment is facilitated between the plunger and the slider unit, without engagement with second arresting means provided at the slider unit. Simple self-adjustment is still guaranteed with respect to the self-adjusting plunger switch according to the invention.

After completed self-adjustment, the first arresting means provided at the plunger can be made to engage with the second arresting means provided at the slider units by means of rotation through a predetermined angle whereby an arrest position between the plunger and the slider unit can be obtained. In this arrest position, there can no longer take place a shifting of the plunger relative to the slider unit, so that unintended shifting of the arrest position is securely eliminated.

In addition, this arrest position offers the advantage that another adjustment process may be executed through another rotation of the plunger into the displacement position. This is for instance required when there was a subsequent adjustment of the braking device and thus a modification of the pedal path.

In the preferred specific embodiment of the invention, the plunger engages in known fashion with an axial recess of the sliding unit, whereby the first arresting means are provided at the sliding unit engaging area of the plunger and the second arresting means are provided at the corresponding partial area of the sliding unit.

It is, however, also conceivable that the plunger can include an axial recess into which an extension of the sliding unit could correspondingly interfit. The first means of arrest and the second means of arrest must then be provided accordingly.

In the preferred specific embodiment of the switch according to the invention, the first and second means of arrest have at least one stop and one cooperating counter stop which together form a locking mechanism.

The second means of arrest in this arrangement can comprise an elastic arm, which engages with the stop, forming the first means of arrest. Consequently, there results a particularly simple and cost-effective construction, including simple installation of the individual switch elements.

At least, the steepness of the recess flanges, pointing in the operating direction of at least one of the stops, must be selected in such fashion that the stop and the resilient arm act as a catch, at least in the operating direction of the plunger. In this manner, in the arrest position, a displacement of the plunger in the operating direction relative to the sliding unit is excluded. On the other hand, the plunger can still be pulled out of the sliding unit by application of adequate tractive force in a direction opposite the operating direction. In this manner, in cases where the operating element for the plunger/sliding unit system has moved further away in its original position from the exterior end of the plunger, the plunger can be re-adjusted in its arrest position.

Preferably, however, both flanks of at least one stop are selected in their steepness in such manner that the stop and the resilient arm act as a catch in both directions.

In the preferred specific embodiment of the invention, the radius of the plunger in the area of at least the one stop of the first means of arrest has been selected in a manner that the plunger or the stop and the interior wall of the axial recess of the sliding unit, limit the radial movement of the resilient arm in the arrest position in such fashion that there occurs a blocking effect in the direction of the longitudinal axis of the plunger. In other words, even if the steepness of the flanks of the top is selected so that, jointly with the resilient arm, an engaged displacement between plunger and sliding unit might be possible, a blocking effect is obtained as a result of the limitation of the radial movement of the resilient arm in its arrest position.

Moreover, in the preferred specific embodiment of the switch according to the invention, the radius of the plunger in the area of the longitudinal side of the plunger that cooperates in the displacement position of the plunger with the resilient arm is selected so that the plunger and the interior wall of the axial recess of the sliding unit ensure the radial movement of the resilient arm to the extent that a displacement of the plunger relative to the sliding unit is made possible.

In this manner, there can be provided a displacement stop on the longitudinal side of the plunger which cooperates in the displacement position with the at least one resilient arm which jointly with the resilient arm facilitates an engaged displacement between the plunger and the sliding unit.

In the preferred specific embodiment of the invention, the plunger has a basically circular cross-section with at least one flattened longitudinal side that cooperates in the displacement position with the resilient arm. In this case, the recess of the sliding unit in which the plunger is engaged, can, for example, also have a cylindrical cross-section with its diameter, in essence, corresponding to the maximum diameter of the plunger. This gives the assurance that the resilient arm when in its arrest position is practically totally integrated with a recess which forms the stop of the first means of arrest, or which is limited at least in its radial movement direction in such fashion that an arrest of the plunger is ensured.

In the preferred specific embodiment of the invention at least one resilient arm is in the form of a spring. The spring is designed as a U-spring and the plunger has an essentially cylindrical shape with flattened opposing sides. The adjustment position in this case exists when the plunger is arranged in such angular position that the flattened longitudinal sides are basically parallel to the two resilient arms of the U-spring. In that position, the two resilient arms can be deflected outwardly in radial direction to a degree that an engaging adjustment of the plunger relative to the slider is possible.

In its preferred form, the plunger has a spaced series of circumferential recesses. Thus, through a rotation of the plunger by 90°, the two resilient arms remain in the same circumferential recess, but, as a result of the enlarged diameter in this position, they are bent outwardly to a degree that further radial elastic movement of the arms is eliminated. This results in secure arrest of the plunger.

In the preferred specific embodiment of the invention, the at least one resilient arm has its anterior zone arranged at a slight angle such that the angulated zone grips behind at least one of flattened sides of the plunger so that as a result any dropping out of the spring is eliminated. Thus, any jumping out by the spring is prevented during rotary movement of the plunger and, in addition, any entanglement of the plunger with the slider is avoided.

In the preferred specific embodiment of the invention, the plunger has at least one longitudinal groove which cooperates with at least one projection at the interior wall of the axial recess of the slider. The relationship is such that there takes place an arrest of the rotary movement of the slider in the arrest position and/or the adjustment position. In such an arrangement, at least one projection can be designed as a resilient tongue provided at a partial area of the wall of the slider.

In the preferred specific embodiment, at least one projection can serve as a stop lug in order to limit the movement of the plunger relative to the slider in the direction opposite to the working direction of the plunger and to interact for that purpose with a contact surface provided at the plunger.

Additional specific embodiments are evident from the dependent claims.

In the following, the invention is explained in more detail on the basis of the specific embodiment illustrated in the drawing.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein:

FIG. 2*a* is a partially refracted lateral view of the slider with the plunger mounted therein according to FIG. 1;

FIG. 2*b* is a longitudinal section through FIG. 2*a* with a plane vertically to the plane of projection;

FIG. 2*c* is a cross-section along line I—I of FIG. 2*b*;

FIG. 2*d* is a representation according to FIG. 2*c* with the plunger rotated 90°;

DETAILED DESCRIPTION OF THE PREFERRED EMBODIMENT

Figure 1:
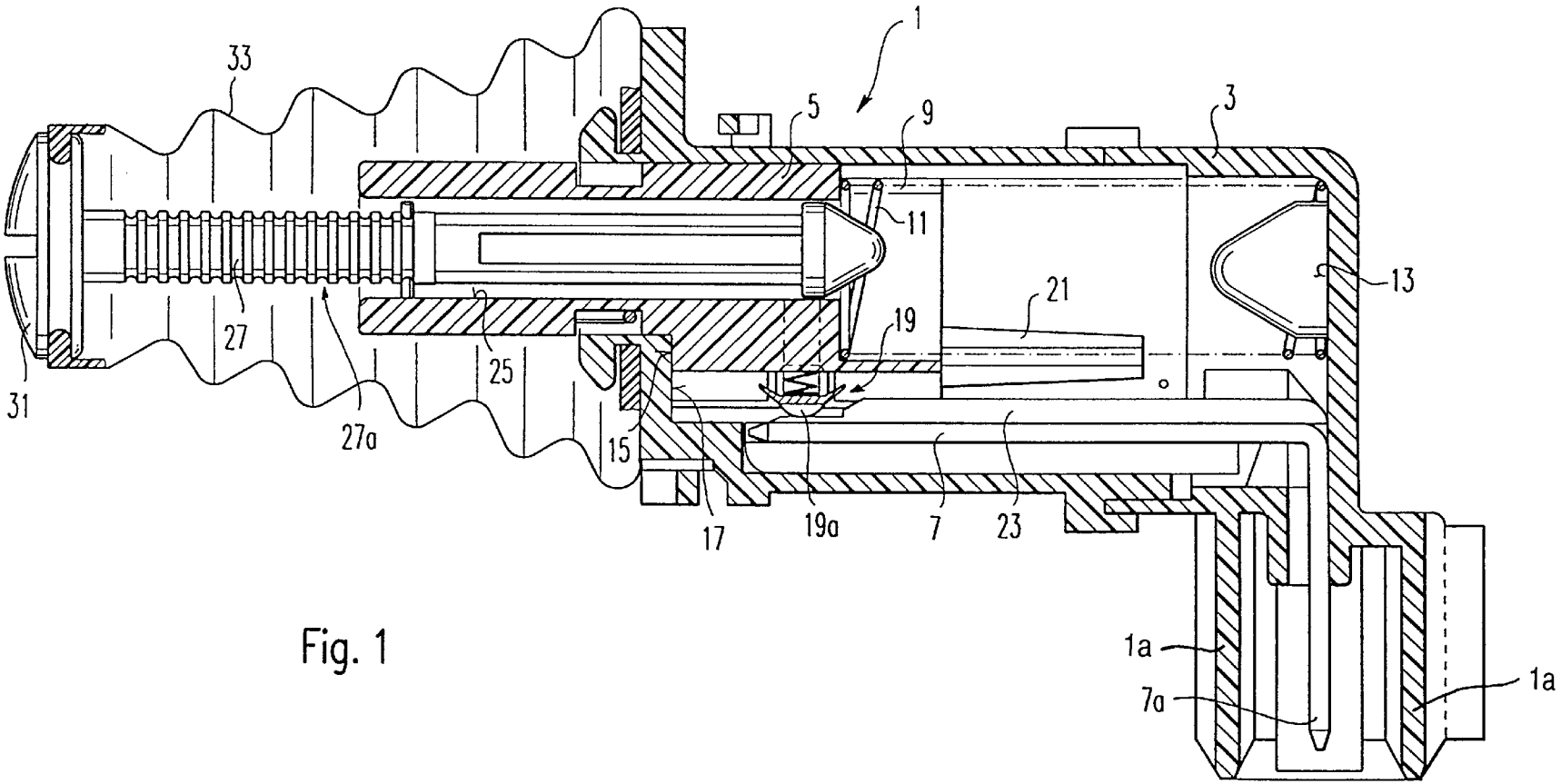
FIG. 1 is a longitudinal section through a specific embodiment of the switch according to the invention.
Figure 3A:
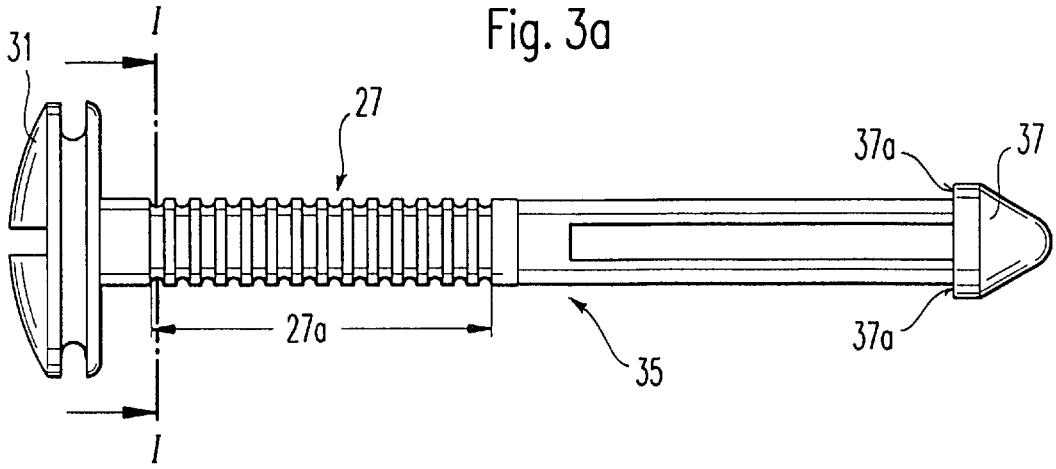
FIG. 3*a* is a lateral view of the plunger.
Figure 3B:
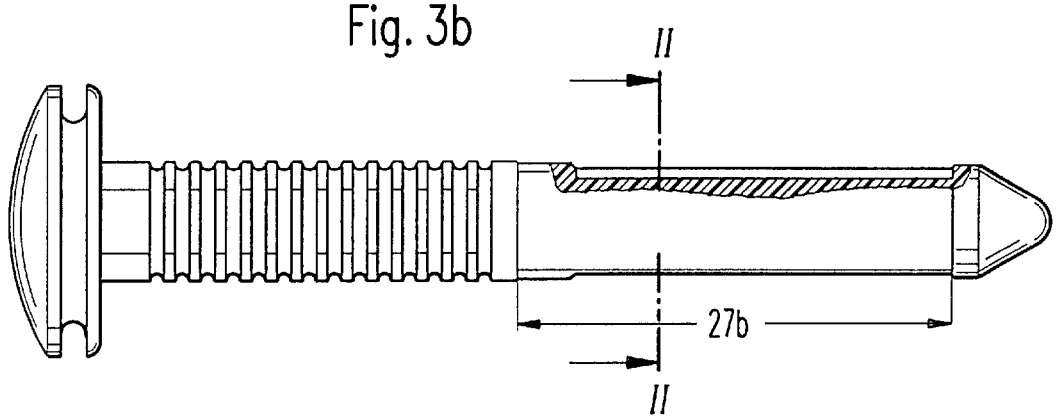
FIG. 3*b* is a lateral view of the plunger rotated around its longitudinal axis by 90°.
Figure 3C:
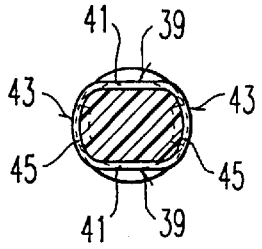
FIG. 3*c* is a section through the plunger along line I—I of FIG. 3*a*; and, FIG. 3*d* is a section through the plunger along the line II—II of FIG. 3*b*.
Figure 3D:
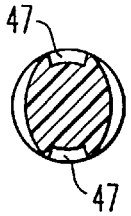

Referring now to the drawings wherein the showings are for the purposes of illustrating the preferred embodiment of the invention only and not for purposes of limiting same, FIG. 1 shows a preferred specific embodiment of a self-adjusting plunger switch 1 which, according to the invention, comprises, in essence, a housing 3 in which a slider 5 is longitudinally displaceably guided. In the housing, a spaced pair of contacts 7 are arranged and have contact ends 7*a* that extend in guided fashion toward the outside in a bushing part 1*a* of housing 3. The contact ends 7*a* can be contacted by an appropriately designed plug (not shown).

On its underside, slider 5 has a recess 9 for acceptance of the end of a helical spring 11. The other end of the helical spring 11 supports itself at the bottom 13 of housing 3. Thus, the slider 5 is stressed by the helical spring 11 in such manner that it is retained in its inoperative position, which is fixed by the contact surfaces 15, 17 of the slider 5 and the housing 3, respectively. On slider 5, there is provided a moving contact 19, which is elastically biased in a direction vertical downward relative to the longitudinal axis of the switch. The contact has two spherical segments 19*a*, each of which slides on the surface of the two stationary contacts 7. In the initial position of slider 5, the contact is closed between the two stationary contacts 7 and thus between the two contact ends 7*a*.

If the slider is stressed with a force in a direction opposite the force of the helical spring 11, then the slider is moved in that direction until it lies with both contact ends 21 engaged with the bottom 13 of housing 3.

With this movement, the moved contact 19, beginning with a certain position, is lifted off the stationary contacts 7 by an elevation 23 formed between the two stationary contacts. Effective from said predetermined position of the slider 5, the contact is thus opened between the two stationary contacts 7 and between the two contact ends 7*a*.

Needless to say, the contacts can also have any other chosen configuration. For example, the contacts can act as closers or several contacts may be provided.

In a generally cylindrical axial recess 25 in slider 5 there is arranged a plunger 27. The plunger 27 has a longitudinal area 27*a* that is designed to function as a stop. The stop area 27*a* is provided with indentations and projections that preferably extend circumferentially. By means of said stop and a spring 29 cooperating with same (FIG. 2), the plunger 27 is lockably adjustable in the recess 25 in slider 5. As a result, the desired function of self-adjustment capability is assured.

For the sake of completeness, it should be mentioned that there may be provided a flexible folding sealing bellows 33 that extends between a head 31 of plunger 27 and housing 3 as protection against dirt and soil. This folding bellows 33 is formed of elastic material and has bulges or flanges provided at both ends that grip in corresponding recesses formed at head 31 of the plunger 27 and at the surface of housing 3.

The arrestability of the plunger 27 in slider 5 according to the invention is explained in more detail by means of FIGS. 2 and 3. The plunger 27, represented in FIG. 3, comprises a shaft 35 on which is formed the previously mentioned longitudinal area 27*a*, as well as a head 31 and a foot 37. Head 31 and foot 37 each have a basically circular cross section.

Shaft 35 has in its longitudinal area 27*a* flattened opposite longitudinal sides 39. The circumferentially extending indentations and projections of the locking device in this area cause formation, as will be made quite clear later on, of the adjustment arrests 41 on the flattened longitudinal sides 39 and at the first means of arrest or stop arrests 45 (FIGS. 2*a* and 2*c*) on the partial cylindrical exterior surfaces 43.

In the remaining part 27*b* of shaft 35, the plunger 27 has a somewhat oval cross section with longitudinal grooves 47 formed in the narrow longitudinal sides.

As is apparent from FIGS. 1 and 2*a*, the slider part 5 is a cylindrical wall in which there is provided the recess 25 for acceptance of plunger 27. The cylindrical wall has a recessed area 49 (see also FIGS. 2*d* and 2*c*) for acceptance of a spring 29. The spring 29 is designed in the shape of a U-spring and has angled arms 29*a* which engage with plunger 27 through corresponding openings in the cylindrical wall. For improved guidance of arms 29, guide grooves, may be designed in the interior wall of the recess 9.

Preferably at opposite sides of the cylindrical wall of slider 5 there is respectively formed a zone 49 for acceptance of a spring 29, resulting in the cross section as represented in FIGS. 2*c* and 2*d*, along line I—I in FIG. 2*b*. The wedge-shaped cross pieces 49*a*, as evidence in FIGS. 2*c* and 2*d*, serve for easier introduction into the recesses 49*b* of the ends of the resilient arms 29*a*.

Even though at opposite sides of slider 5 there is, respectively, provided a zone 49 for acceptance of a spring 29 for the arrest of plunger 27, there clearly is needed only one single spring which, however, can be accepted by each of the zones 49.

The design of spring 29 as an angulated U-spring results in the benefit of simple installation in a simple holder in slider 5. Additionally, through the correspondingly long design of the resilient arms (i.e., the angulated arms 29*a*) and the arm component extending parallel to the longitudinal axis of the slider, adjustment is possible with respect to practically each desired spring constant.

Function of the switch according to the invention thus presents itself as follows.

When installing the switch, for example in the capacity as a brake switch, the plunger is initially only inserted in the slider 5 with installed spring 29 up to a point until plunger 5 with the first recess of the adjustment stop 41 engages with the arms 29*a* of spring 29. For that purpose, plunger 27 must obviously be installed in the recess 9 of slider 5 in such fashion that the flattened longitudinal sides 39 of the longitudinal zone 27*a* extend parallel to the arms 29*a*. In this adjustment position, the complete system comprised of plunger 27 and slider 5 is then installed in the vehicle in the desired position.

After completed installation in the vehicle, the actuation component for the switch, for example the brake pedal, is then forcefully pressed so that there takes place a self-adjustment of the plunger relative to the slider in the previously described manner.

After completion of self-adjustment, the plunger is manually rotated by 90, whereby stop lugs 51 (FIG. 2*a*) provided in the lower zone of recess 9 of slider 5, serve as flexible, elastic tongues and engage with the longitudinal grooves at the narrow sides of area 27*e* of plunger 27. The cross section of shaft 35 in the area 27*b* is thereby designed in such fashion that the desired power path is generated for the rotary movement of the plunger and the engagement with the stop lugs 51. It goes without saying, the spring force of the resilient arms 29*a* and their interaction with the area 27*a* is likewise a significant factor. In this position, there occurs an arrest between plunger and slider since, according to FIG. 2*c*, the diameter of the plunger in the area of the partial circular-cylindrical exterior surface 43 or the arrest lugs 45 is selected in such manner that the resilient arms 29*a* are pressed against the interior wall of recess 49 of slider 5.

The locking between the longitudinal grooves 47 and the stop lugs 51 is preferably designed in such manner that the rotary movement of the plunger by 90° each time, from arrest position to adjustment position and vice versa, is possible in any chosen direction.

As is evident from FIG. 2*a*, the stop lugs 51 additionally fulfill the task of a stop inasmuch as they prevent, together with the contact surfaces 37*a* of foot 37 in the area of the broad sides of area 27*b* of shaft 35, the extraction, in adjustment position, of plunger 27 from recess 9 of shaft 5.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A self-adjusting plunger switch comprising:

a housing carrying at least one contact member;

an actuation element guided in said housing for actuation of said at least one contact member;

a resilient element in said housing biasing said actuation element outwardly of said housing toward an inoperative position; and, said actuation element including a plunger and a slider and including therebetween cooperating first arresting means and a second arresting means for allowing relative axial adjustment between said plunger and said slider while permitting rotational movement of the plunger when said plunger is disposed in a first rotational position relative to said slider and to obtain an arrest of an adjustment position between said plunger and said slider when said plunger is disposed in a second rotational position relative to said slider.

2. A plunger switch according to claim 1 wherein the plunger includes a zone and the slider includes an axial recess and wherein the first arresting means is provided at said zone and the second arresting means is in the slider.

3. A plunger switch according to claim 2 wherein the first and second arresting means comprise cooperating stop elements which form a locking mechanism.

4. A plunger switch according to claim 3 wherein the second arresting means has at least one resilient arm which engages with the first arresting means.

5. A plunger switch according to claim 4 wherein the first arresting means includes at least one longitudinal groove, which cooperates with at least one projection at the interior wall of the axial recess.

6. A plunger switch according to claim 5 wherein the projection forms an elastic tongue and is located in a wall of the slider.

7. A plunger switch according to claim 5 wherein the projection is adapted to form a stop lug for limiting the movement of the plunger.

8. A plunger switch according to claim 4 wherein the second arresting means comprises a U-spring having arms that respectively cooperate with opposite longitudinal sides of the plunger.

9. A plunger switch according to claim 4 wherein the plunger is generally cylindrical and has a radius wherein said radius is adjacent to the first arresting means such that the plunger and an interior wall of the axial recess of the slider limit radial movement of at least the one resilient arm.

10. A plunger switch according to claim 9 wherein the plunger has at least the one longitudinal side with a radius which, in said adjustment position of the plunger, cooperates with the at least one resilient arm and the inner wall of the axial recess to allow the at least one resilient arm to move radially to permit axial displacement of the plunger relative to the slider.

11. A plunger switch according to claim 10 wherein, in the adjustment position, the at least one longitudinal side of the plunger cooperates with the at least one resilient arm, and wherein there is provided an adjustment locking mechanism which together with the at least one resilient arm forms a lockable adjustment between plunger and slider.

12. A self-adjusting plunger switch comprising:

a housing carrying at least one contact;

an actuation element guided in said housing for actuation of said at least one contact;

a resilient element in said housing biasing said actuation element outwardly of said housing toward an inoperative position;

said actuation element including a plunger and a slider and including therebetween a first arresting means and a second arresting means for allowing axial adjustment between said plunger and said slider while permitting rotational movement of said plunger around its longitudinal axis to obtain an arrest of an adjustment position between said plunger and said slider;

said plunger further including a zone and said slider including an axial recess and wherein the first arresting means is provided at said zone and the second arresting means is in the slider;

the first and second arresting means including cooperating stop elements which form a locking mechanism;

the second arresting means having at least one resilient arm adapted to engage the first arresting means; and, the second arresting means including a U-spring having arms that respectively cooperate with opposite longitudinal sides of the plunger.

13. A plunger switch according to claim 12 wherein the first arresting means comprises a series of recesses and flanges, said flanges defining a slope, wherein said slope of said flanges is selected such that said flanges and at least the one resilient arm act as a locking mechanism for said plunger.

14. A plunger switch according to claim 4 wherein the first arresting means comprises a series of recesses and flanges, said flanges defining a slope, wherein said slope of said flanges are selected such that said flanges and at least the one resilient arm act as a locking mechanism for said plunger.

15. A self-adjusting plunger switch comprising:

a housing carrying at least one contact;

an actuation element guided in said housing for actuation of said at least one contact;

a resilient element in said housing biasing said actuation element outwardly of said housing toward an inoperative position;

said actuation element including a plunger and a slider and including therebetween a first arresting means and a second arresting means for allowing axial adjustment between said plunder and said slider while permitting rotational movement of said plunger around its longitudinal axis to obtain an arrest of an adjustment position between said plunger and said slider;

the plunger further including a zone and the slider including an axial recess and wherein the first arresting means is provided at said zone and the second arresting means is in the slider;

the first and second arresting means including cooperating stop elements which form a locking mechanism;

the second arresting means having at least one resilient arm adapted to engage the first arresting means; and, the plunger being generally cylindrical and having a radius, said radius being adjacent to the first arresting means such that the plunger and an interior wall of the axial recess of the slider limit radial movement of at least the one resilient arm.

16. A plunger switch according to claim 15 wherein the plunger has at least the one longitudinal side with a radius which, in an adjustment position of the plunger, cooperates with the at least one resilient arm and the inner wall of the axial recess to allow the at least one resilient arm to move radially the extent that axial displacement of the plunger relative to the slider is possible.

17. A plunger switch according to claim 16 wherein the at least one longitudinal side of the plunger is adapted to cooperate with the at least one resilient arm to form a lockable adjustment between plunger and slider.

18. A plunger switch according to claim 4 wherein the axial recess has an essentially circular-cylindrical cross-section.

19. A plunger switch according to claim 18 wherein the plunger has a substantially circular cross-section with at least one flattened longitudinal side which in the adjustment position cooperates with the at least one resilient arm.

20. A plunger switch according to claim 19 wherein the at least one resilient arm has an end having an angular shape.

21. A self-adjusting plunger switch comprising:

a housing carrying at least one contact;

an actuation element guided in said housing for actuation of said at least one contact;

a resilient element in said housing biasing said actuation element outwardly of said housing toward an inoperative position;

said actuating element including a plunger and a slider and including therebetween a first arresting means and a second arresting means for allowing axial adjustment between said plunger and said slider while permitting rotational movement of said plunger around its longitudinal axis to obtain an arrest of an adjustment position between said plunger and said slider;

the plunger further including a zone and having a substantially circular cross-section with at least one flattened longitudinal side which in the adjustment position cooperates with the at least one resilient arm and the slider including an axial recess and wherein the first arresting means is provided at said zone and the second arresting means is in the slider, the first and second arresting means including cooperating stop elements which form a locking mechanism; and, the second arresting means having at least one resilient arm adapted to engage the first arresting means.

22. A plunger switch according to claim 2 wherein the plunger has a first arresting means for fixation of the adjustment position and the arresting position.

23. A plunger switch according to claim 21 wherein the first arresting means has at least one longitudinal groove, which is adapted to cooperate with at least one projection at the interior wall of the axial recess.

24. A plunger switch according to claim 23 wherein the projection forms an elastic tongue and is located in a wall of the slider.

25. A plunger switch according to claim 23 wherein the projection is adapted to form a stop lug for limiting the movement of the plunger.

26. A plunger switch according to claim 21 wherein the at least one resilient arm has an end having an angular shape.

27. A plunger switch according to claim 1 wherein the plunger includes a first arresting means for fixation of the adjustment position and the arresting position.

* * * * *